US008334814B2

(12) United States Patent
Lindenmeier et al.

(10) Patent No.: US 8,334,814 B2
(45) Date of Patent: Dec. 18, 2012

(54) ANTENNA FOR CIRCULAR POLARIZATION, HAVING A CONDUCTIVE BASE SURFACE

(75) Inventors: Stefan Lindenmeier, Gauting (DE); Heinz Lindenmeier, Planegg (DE); Jochen Hopf, Haar (DE); Leopold Reiter, Gilching (DE)

(73) Assignee: Delphi Delco Electronics Europe GmbH, Troy, MI (US)

( * ) Notice: Subject to any disclaimer, the term of this patent is extended or adjusted under 35 U.S.C. 154(b) by 401 days.

(21) Appl. No.: 12/786,236

(22) Filed: May 24, 2010

(65) Prior Publication Data

US 2010/0302112 A1 Dec. 2, 2010

(30) Foreign Application Priority Data

May 30, 2009 (DE) ..... 10 2009 023 514

(51) Int. Cl.
*H01Q 21/00* (2006.01)

(52) U.S. Cl. ..... 343/727; 343/713; 343/725; 343/767

(58) Field of Classification Search ..... None
See application file for complete search history.

(56) References Cited

U.S. PATENT DOCUMENTS 3,942,119 A 3/1976 Meinke et al.
4,070,677 A 1/1978 Meinke et al.
4,095,228 A 6/1978 Meinke et al.
4,129,871 A * 12/1978 Johns ..... 343/727
4,602,260 A 7/1986 Lindenmeier et al.
4,752,968 A 6/1988 Lindenmeier et al.
4,791,426 A 12/1988 Lindenmeier et al.
4,914,446 A 4/1990 Lindenmeier et al.
5,021,797 A * 6/1991 Dienes ..... 343/727
5,029,308 A 7/1991 Lindenmeier et al.
5,049,892 A 9/1991 Lindenmeier et al.
5,097,270 A 3/1992 Lindenmeier et al.
5,138,330 A 8/1992 Lindenmeier et al.

(Continued)

FOREIGN PATENT DOCUMENTS

JP 2006 186880 7/2000

OTHER PUBLICATIONS

U.S. Appl. No. 12/689,969, filed Jan. 19, 2010.

(Continued)

*Primary Examiner* — Anh Tran
(74) *Attorney, Agent, or Firm* — J. Gordon Lewis

(57) ABSTRACT

An antenna for circular polarization having an electrical dipole radiator which is oriented essentially parallel to an electrically conductive base surface in a plane of symmetry SE oriented perpendicular to the electrically conductive base surface. The dipole is in connection with a slot radiator which is configured in an electrically conductive base surface, with its longitudinal expanse along the intersection line between the plane of symmetry SE and the electrically conductive base surface. The slot radiator connection location is formed by means of connection points situated at the longitudinal edges and lying opposite one another. The electrical dipole radiator and the slot radiator are tuned to one another in their resonance frequencies. The slot radiator and the electrical dipole radiator with dipole feed line are connected with the antenna connection location by way of a combining network, in terms of magnitude and phase, in such a manner that circular polarization exists in the remote field at the frequency at which the radiators are tuned to one another.

20 Claims, 5 Drawing Sheets

U.S. PATENT DOCUMENTS 5,266,960 A 11/1993 Lindenmeier et al.
5,272,487 A * 12/1993 Pantsios ..... 343/727
5,289,197 A 2/1994 Lindenmeier et al.
5,313,660 A 5/1994 Lindenmeier et al.
5,589,839 A 12/1996 Lindenmeier et al.
5,619,214 A 4/1997 Lindenmeier et al.
5,801,663 A 9/1998 Lindenmeier et al.
5,818,394 A 10/1998 Aminzadeh et al.
5,826,179 A 10/1998 Lindenmeier et al.
5,850,198 A 12/1998 Lindenmeier et al.
5,905,469 A 5/1999 Lindenmeier et al.
5,926,141 A 7/1999 Lindenmeier et al.
5,929,812 A 7/1999 Aminzadeh
5,949,498 A 9/1999 Rudolph
5,973,648 A 10/1999 Lindenmeier et al.
6,011,962 A 1/2000 Lindenmeier et al.
6,123,550 A 9/2000 Burkert et al.
6,130,645 A 10/2000 Lindenmeier et al.
6,140,969 A 10/2000 Lindenmeier et al.
6,169,888 B1 1/2001 Lindenmeier et al.
6,184,837 B1 2/2001 Lindenmeier et al.
6,188,447 B1 2/2001 Rudolph et al.
6,218,997 B1 4/2001 Lindenmeier et al.
6,236,372 B1 5/2001 Lindenmeier et al.
6,313,799 B1 11/2001 Thimm et al.
6,317,096 B1 11/2001 Daginnus et al.
6,377,221 B1 4/2002 Lindenmeier et al.
6,400,334 B1 6/2002 Lindenmeier et al.
6,421,532 B1 7/2002 Lindenmeier et al.
6,430,404 B1 8/2002 Lindenmeier et al.
6,574,460 B1 6/2003 Lindenmeier et al.
6,603,434 B2 8/2003 Lindenmeier et al.
6,603,435 B2 8/2003 Lindenmeier et al.
6,611,677 B1 8/2003 Lindenmeier et al.
6,633,258 B2 10/2003 Lindenmeier et al.
6,653,982 B2 11/2003 Lindenmeier et al.
6,768,457 B2 7/2004 Lindenmeier
6,888,508 B2 5/2005 Lindenmeier
6,911,946 B2 6/2005 Lindenmeier
6,917,340 B2 7/2005 Lindenmeier
6,925,293 B2 8/2005 Lindenmeier et al.
6,927,735 B2 8/2005 Lindenmeier et al.
6,956,533 B2 10/2005 Lindenmeier
7,127,218 B2 10/2006 Lindenmeier
7,403,167 B2 7/2008 Probst et al.
7,555,277 B2 6/2009 Lindenmeier et al.
7,564,416 B2 7/2009 Lindenmeier et al.
7,702,051 B2 4/2010 Lindenmeier et al.
2001/0016478 A1 8/2001 Lindenmeier et al.
2002/0118138 A1 8/2002 Lindenmeier et al.
2002/0126055 A1 9/2002 Lindenmeier et al.
2002/0154059 A1 10/2002 Lindenmeier et al.
2002/0171600 A1 11/2002 Lindenmeier et al.
2002/0196183 A1 12/2002 Lindenmeier
2003/0164802 A1 9/2003 Lindenmeier
2004/0113854 A1 6/2004 Lindenmeier
2004/0160373 A1 8/2004 Lindenmeier
2004/0164912 A1 8/2004 Lindenmeier et al.
2004/0183737 A1 9/2004 Lindenmeier
2004/0198274 A1 10/2004 Lindenmeier
2006/0082494 A1 4/2006 Deininger et al.
2006/0114146 A1 6/2006 Lindenmeier et al.
2006/0182201 A1 8/2006 Lindenmeier et al.
2007/0058761 A1 3/2007 Lindenmeier
2007/0140389 A1 6/2007 Lindenmeier et al.
2008/0218422 A1 9/2008 Lindenmeier et al.
2008/0248770 A1 10/2008 Schutz et al.
2008/0260079 A1 10/2008 Lindenmeier et al.
2009/0036074 A1 2/2009 Lindenmeier et al.
2009/0042529 A1 2/2009 Lindenmeier et al.
2009/0073072 A1 3/2009 Lindenmeier et al.
2010/0066618 A1 3/2010 Heuer

OTHER PUBLICATIONS

U.S. Appl. No. 12/716,318, filed Mar. 3, 2010.
European Search Report dated Jul. 19, 2010.

* cited by examiner

ANTENNA FOR CIRCULAR POLARIZATION, HAVING A CONDUCTIVE BASE SURFACE

CROSS REFERENCE TO RELATED APPLICATIONS

This application is a US application that hereby claims priority from German Application Serial No. 102009023514 filed on May 30, 2009 the disclosure of which is hereby incorporated herein by reference in its entirety.

BACKGROUND

One embodiment relates to an antenna for circular polarization, having an electrical dipole radiator that runs at a distance from the front side of an electrically conductive base surface and in a plane of symmetry oriented perpendicular to the base surface. The antenna has polarization oriented essentially parallel to the base surface, and a feed line that runs in the plane of symmetry toward the base surface.

One way to configure an antenna for circular polarization could include using two different dipole antennas that are structured in the same manner. At least one of the dipole antennas would be oriented perpendicular both to the plane of symmetry of the first dipole antenna and to an electrically conductive base surface. The two dipole radiators are switched together by way of a 90° phase rotation element, and the combined signal is passed to the base surface by way of a feed line. Antennas of this type are known, for example, from DE 4008505 A1. They are frequently used for reception of satellite radio services—such as Inmarsat, SDARS, Worldspace, etc., for example. Particularly when using such antennas on the outer skin of vehicles, it proves to be disadvantageous that the antenna—when the antenna is installed on the outer skin of the vehicle—represents a three-dimensional structure on its outside. Frequently, there is a need, for example when affixing the antenna to a vehicle roof or to a fender, for a two-dimensional structure, or for a substantially two dimensional structure which comprises a flat planar device or fin.

A substantially two dimensional structure to a great extent, has an expanse of which, is minimally transverse to the direction of travel. This is desirable both for reasons of low noise due to air eddies and for stylistic reasons. This requirement applies, to a particular degree, for the parts of the antenna that project beyond the outer skin of the vehicle, while low transverse dimensions in the plane of the outer skin are not problematical. A design such as this then cuts down on noise generated from wind interference.

SUMMARY

Therefore, at least one embodiment is configured as an antenna for circular polarization, which fits in a substantially single plane, in a substantially two dimensional area such as a fin shaped or substantially planar shaped housing.

Antennas according to at least one embodiment of the invention can result in an antenna that can advantageously be used outside the body of a vehicle or aircraft, particularly because of their ability to be configured in advantageous manner in terms of flow technology or aerodynamics, in combination with their low construction volume.

At least one embodiment relates to an antenna for circular polarization, comprising an electrical dipole radiator. This antenna can have an electrically conductive base surface having a front side and a back side, and have an antenna connection location on the front side. The electrical dipole radiator is coupled to said electrically conductive base surface and runs at a distance along the front side of the electrically conductive base surface and in a plane of symmetry oriented perpendicular to the electrically conductive base surface. The electrical dipole radiator is oriented essentially parallel to the electrically conductive base surface. The term essentially parallel or substantially parallel is a condition including the parallel extension and a position just of from the parallel extension, with the tolerances being within industry standards, for example, within a range of tolerance of +/−20 degrees.

At least one embodiment can have a dipole feed line coupled at a first end to said electrical dipole radiator, said dipole feed line having a dipole connection location which connects to the electrical dipole radiator, wherein the dipole feed line runs in the plane of symmetry toward the electrically conductive base surface. In addition, this embodiment can comprise a slot radiator configured in, and coupled to the front side of the electrically conductive base surface. The slot radiator can have a longitudinal expanse along an intersection line between the plane of symmetry and the electrically conductive surface.

The slot radiator can comprise a plurality of longitudinal edges. This slot radiator can comprise at least one slot radiator connection location. This slot radiator can also comprise a plurality of connection points configured to connect the dipole feed line to the slot radiator. The plurality of connection points can also be configured to connect to the antenna connection location and can comprise at least one set of connection points situated at the plurality of longitudinal edges and lying opposite one another. These connection points can be disposed in the at least one slot radiator connection location.

There can also be a combining network comprising a connection between the electrical dipole radiator having the dipole feed line, the slot radiator, and the antenna connection location.

The electrical dipole radiator and the slot radiator are tuned to one another in their resonance frequencies, in terms of magnitude and phase, so that circular polarization exists in a remote field at a frequency at which said radiators are tuned to one another.

This design allows for a circularly polarized dipole antenna to be constructed as an element distributed along a single plane or a substantially single plane, and installed in a fin type or blade type housing, wherein this antenna extends substantially only along a single plane while simultaneously providing a circularly polarizing solution.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1:
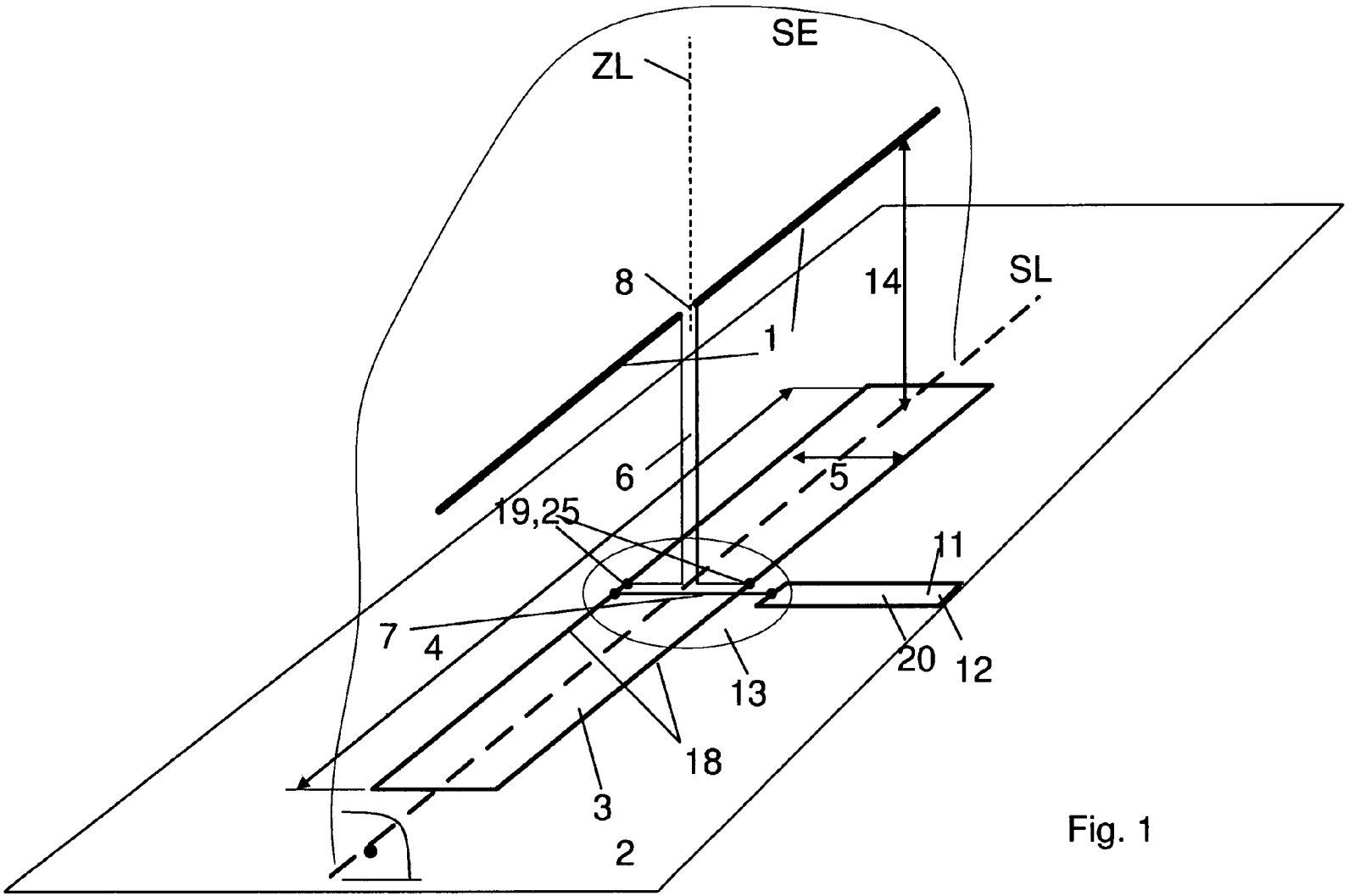
FIG. 1 shows a schematic perspective view of a first embodiment of an antenna system.

FIG. 1 shows a perspective schematic view of a fundamental principle of an antenna, having an extended dipole 1 and having the electrical length of half a wavelength (λ/2). The antenna has a feed line 6, above an electrically conductive base surface 2. There is a slot radiator 3 on the base surface 2, spaced at a distance 14 of preferably about one-quarter wavelength from dipole 1. There is also a combining network 13 which provides a simple parallel branching and an antenna line 11 structured as a strip line 20.

Figure 2:
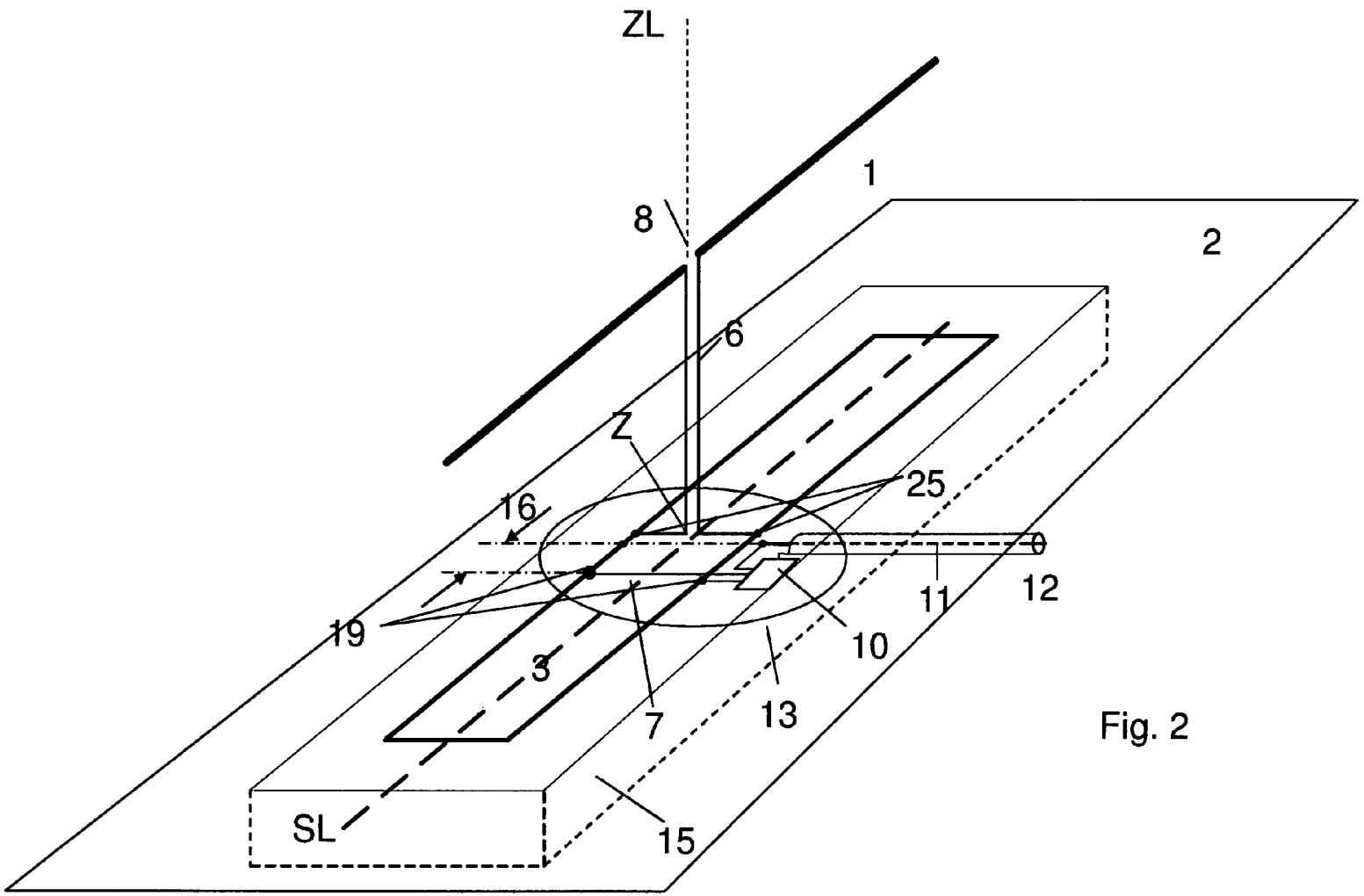
FIG. 2 shows a schematic perspective view of a second embodiment.

FIG. 2 shows a perspective schematic view of another embodiment showing an antenna similar to FIG. 1, but with a combining network 13 having an adaptation network 10 composed of concentrated dummy elements for setting the correct phases for feed of the slot radiator 3 and of the dipole radiator 1, and for adaptation of the impedances for the required power splitting.

Figure 3:
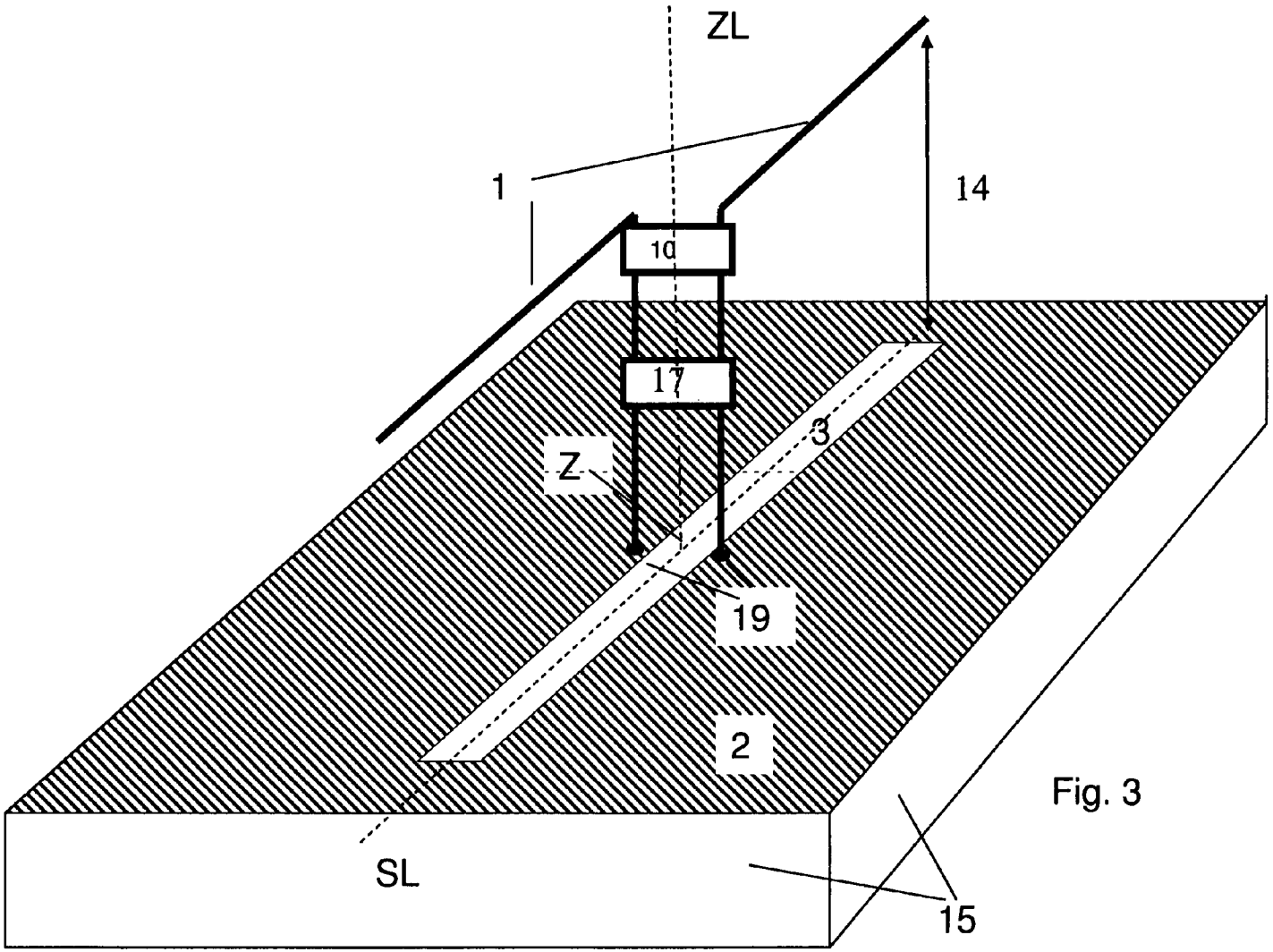
FIG. 3 shows a schematic perspective view of a third embodiment.

FIG. 3 shows another embodiment of an antenna as in FIG. 2, but with a phase shifter network 17 in dipole feed line 6 for adhering to the phase condition of the electromagnetic fields of the slot radiator 3 and of the electrical dipole radiator 1 in the remote field, which are shifted by 90°, relative to one another, in terms of time, as well as an adaptation network 10 for adaptation of the dipole impedance to the dipole feed line 6.

Figure 4:
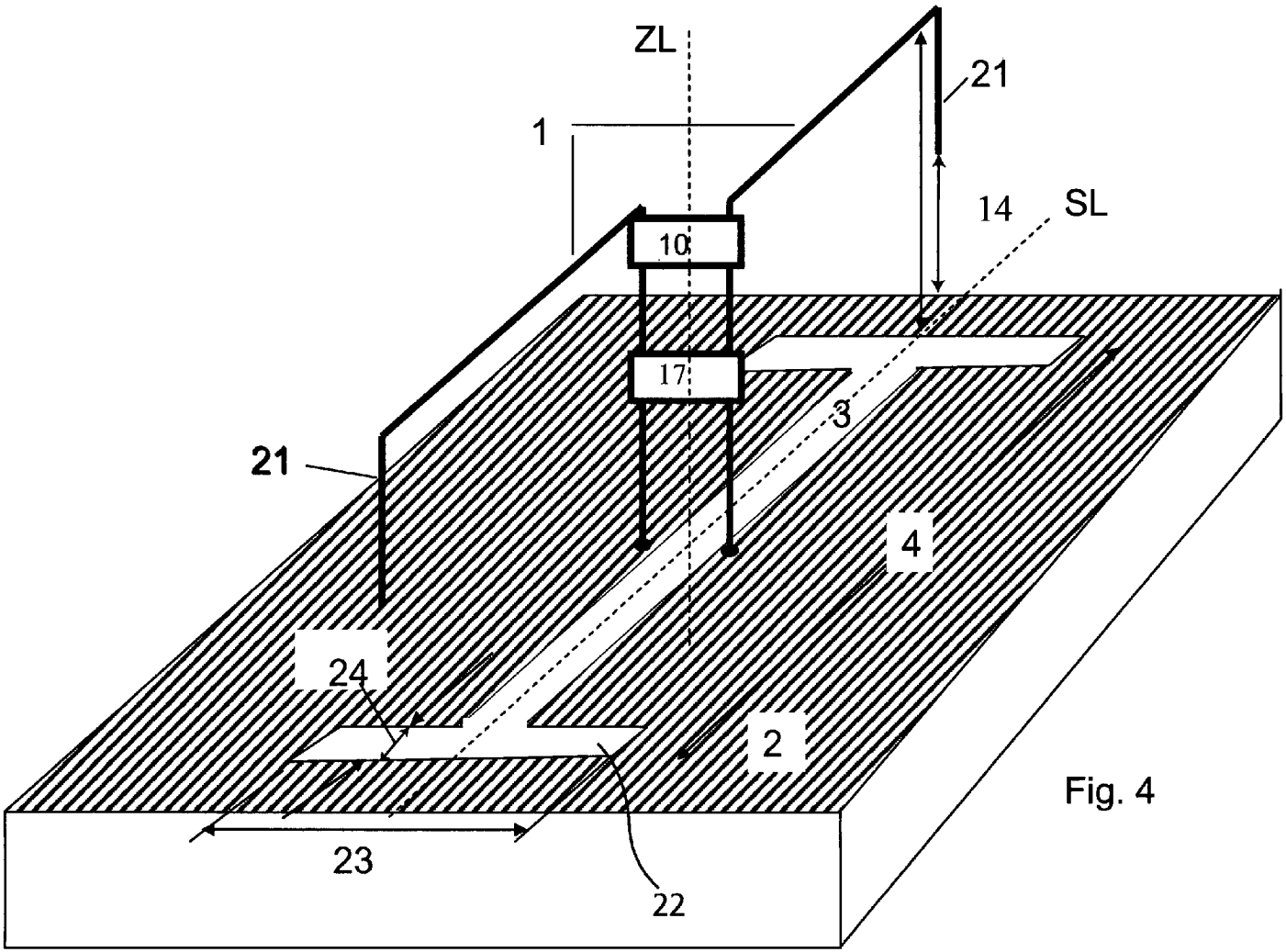
FIG. 4 shows a schematic perspective view of another embodiment.

FIG. 4 shows another schematic block diagram of another embodiment similar to that as in FIG. 3, but with short transverse slots 22 at the two ends of the slot radiator 3, to reduce the longitudinal expanse 4 of slot radiator 3, and with end capacitors 21 to reduce the length of the electrical dipole radiator 1.

Figure 5:
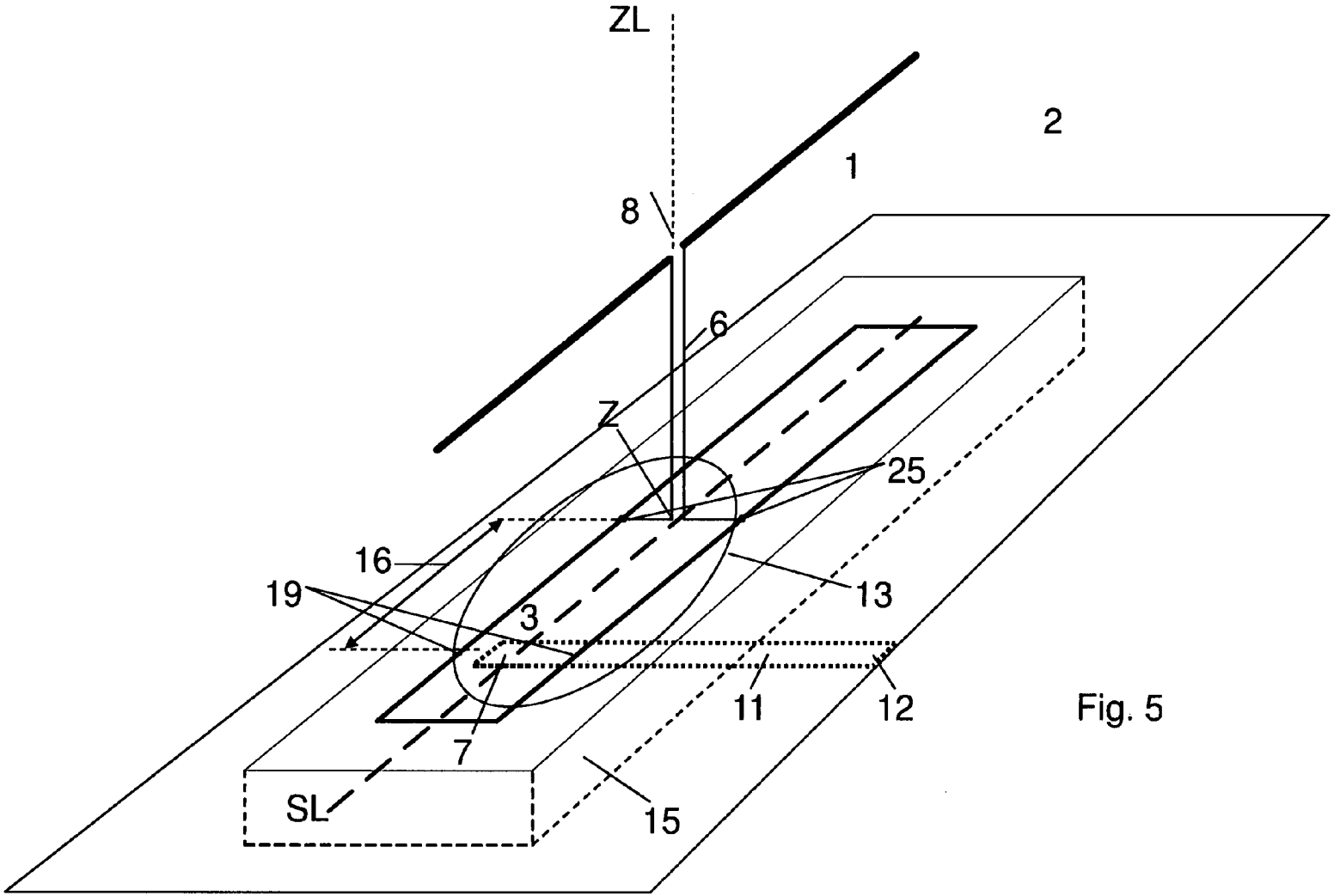
FIG. 5 shows a schematic perspective view of another embodiment.

FIG. 5 shows an antenna, similar to that shown in FIG. 4, with a feed of the slot radiator 3 by way of a micro-strip line 20, for simpler and low-loss adaptation to the antenna line 11.

In the past, antennas that have circular polarization are generated so that two linearly polarized antennas, oriented perpendicular in terms of the spatial longitudinal expanse relative to one another, are present, which generate the two electromagnetic fields in the remote field of the antenna, which fields are oriented spatially perpendicular to one another and displaced by 90° relative to one another, in terms of phase. At least one embodiment of the present invention shows a solution that makes it possible for two linearly polarized antennas to be combined, but with a longitudinal expanse that essentially runs along a common line. This solution comprises a combination of a slot radiator 3, which is configured in an electrically conductive base surface 2 along its longitudinal symmetry line SL, and a dipole radiator 1 disposed at the dipole distance 14 above this electrically conductive base surface 2, and parallel both to the electrically conductive base surface 2 and to the longitudinal symmetry line SL.

FIG. 1 shows the basic form of an antenna for circular polarization which shows one embodiment. To configure a slot radiator 3 in the conductive base surface 2, a slot having its longitudinal expanse 4 along the intersection line between the plane of symmetry SE and the conductive base surface 2 is formed in conductive base surface 2. The slot radiator has the slot radiator connection location 7, which is configured by slot connection points 19, which are situated on longitudinal edges 18 that lie opposite one another, and lie adjacent to one another.

To configure the antenna for circular polarization, the electrical dipole 1 with dipole connection location 8 is affixed at a distance from the front side of the electrically conductive base surface 2. This radiator is oriented essentially parallel to the electrically conductive base surface 2, and runs in a plane oriented perpendicular to the electrically conductive base surface 2, called the plane of symmetry SE. The electrical dipole radiator 1 is connected, with its dipole connection location 8, to the dipole feed line 6, which is passed to the electrically conductive base surface 2 in the plane of symmetry SE, and runs essentially perpendicular toward the electrically conductive base surface 2.

The circular polarization is formed by means of the electromagnetic radiation field of the slot radiator 3 introduced into the electrically conductive base surface 2, the electrical field of which radiator is oriented perpendicular to its longitudinal expanse 4 in the remote field.

To generate an electrical radiation field that is oriented perpendicular or substantially perpendicular to the radiation field of the electrical dipole radiator 1 at the receiving point, as required for circular polarization, the slot radiator 3 is therefore disposed with its longitudinal expanse 4 along the intersection line between the plane of symmetry SE and the electrically conductive base surface 2.

The slot radiator connection location 7 is formed by slot connection points 19 that lie opposite one another and are situated on the longitudinal edges 18 of the slot radiator 3. To achieve advantageous radiation properties and impedance adaptation conditions, both the electrical dipole radiator 1 and the slot radiator 3 are tuned to their resonance frequency, at which the antenna impedance is essentially real, at the frequency for which the antenna is configured.

In the interests of a small construction size of the antenna, the half wavelength resonance (λ/2) of the two radiators, in each instance, is therefore of significance. The basic characteristics desired are 1) the orthogonality condition of the radiation fields of the two radiators, which fields are superimposed on one another in the remote field, 2) the condition of a time shift of +/−90° degrees, depending on the direction of rotation; 3) the equality of the intensity of the superimposed radiation fields. This equality can be achieved, taking into consideration the different vertical directional diagrams for a broad range of the elevation angle for a sufficient cross-polarization distance.

Setting this elevation angle range takes place, by way of the configuration of the combining network 13, by way of which both the slot radiator 3 and the electrical dipole radiator 1 with dipole feed line 6 are connected with the antenna connection location 12. Network 13 is configured so that at the frequency at which the two radiators are turned for resonance, the signals in effect at the dipole connection location 8 and at the slot radiator connection location 7 possess those values, in terms of magnitude and phase, such that circular polarization exists in the remote field.

In one embodiment, slot radiator 3 with slot radiator connection location 7 is introduced into the electrically conductive base surface 2 as an elongated, approximately rectangular slot having essentially or substantially straight longitudinal edges 18. The frequency bandwidth at the resonance frequency determined by longitudinal expanse 4 of the slot results from the small slot width 5, in comparison with the longitudinal expanse 4 for example, (lambda/8).

Round radiation properties of the antenna can be achieved in simple manner, by adhering to symmetry conditions. For this purpose, slot radiator 3 is configured symmetrical to the intersection line between the plane of symmetry SE and the electrically conductive base surface 2, referred to as the longitudinal symmetry line SL. The other symmetry condition that is easy to adhere to is the symmetrical configuration of the electrical dipole radiator 1 and its symmetrical feed to the symmetry line ZL that stands perpendicular on the electrically conductive base surface 2 and runs through the center Z of the slot. The symmetrical feed at the dipole connection location 8 occurs by way of dipole feed line 6, which essentially runs symmetrical to the symmetry line ZL.

FIG. 2 is similar to FIG. 1 but also discloses a cavity resonator 15. Cavity resonator 15 is configured to support the radiation on the front side of the electrically conductive base surface 2 that faces the electrical dipole radiator 1, by means of shielding against the radiation on its back. In this case, the slot radiator 3 is covered by a cavity resonator 15 on the back of the base surface 2.

Cavity resonator 15 is advantageously configured as a conductively edged cavity body, which completely covers the slot radiator 3 and which is connected, in electrically conductive manner, with the electrically conductive base surface 2, so that complete shielding against the radiation of the electromagnetic fields of the slot radiator 3 is present in the half-space that is situated on the back of the electrically conductive base surface 2. The reactive energy stored in the cavity influences the resonance properties of the slot radiator 3—as a function of the dimensions of the cavity. In the interests of a real impedance at the slot radiator connection location 7, the longitudinal expanse 4 of the slot radiator 3 is selected to be about half a wavelength (λ/2).

The surface area of the electrically conductive base surface 2 should be sufficiently large relative to the slot radiator 3. Therefore, in at least one embodiment, the electrically conductive base surface should have at least the following surface area dimensions: a length equal to at least lambda or the wavelength (longest dimension) and a width equal to at least lambda/2 on the shortest side or width. This surface area is desirable to provide sufficient shielding for back radiation of slot radiator 3.

In one embodiment of the cavity body, this body is selected to be block-shaped, as indicated in FIG. 2. Thus, the expanse of the hollow body in the longitudinal direction of the slot is at least as great as half a wavelength (λ/2), and it is practical if its dimension transverse to the longitudinal direction of the slot is selected to be greater than (λ/4), if it is placed symmetrically.

Since the slot is disposed approximately at the level of the electrically conductive surface 2, and the hollow body lies underneath, no stylistic disadvantages are connected with this for use in vehicles, for example, because the housings that cover the antennas become wider toward the bottom, in order to achieve sufficient strength. Its dimension perpendicular to the electrically conductive base surface 2 is advantageously selected to be greater than (λ/10), depending on the required bandwidth of the slot radiator 3. In this connection, it is practical if the center of the block-shaped cavity body is selected to lie on the vertical symmetry line ZL.

In at least one embodiment, the dipole distance 14 from the electrically conductive base surface 2, is used to configure the circular polarization of the antenna, and is selected to be about one-quarter of the free-space wavelength.

To generate the circularly polarized radiation at the elevation angle of 90°, the phase difference of the signals at the dipole connection location 8 and the slot radiator connection location 7 is to be selected as 0° or a whole-number multiple of 180°, depending on the direction of rotation of the circular polarization. With a particularly simple combining network 13 shown in FIG. 1, it is advantageous to select the phase difference for this elevation angle to be 180°, in the interests of as short a dipole feed line 6 as possible. The electrical length of the dipole feed line 6 then magnitudes to approximately λ/2, and can be implemented for bridging the geometric distance of λ/4 between the slot connection points 19 and the dipole radiator connection location 8.

The required superimposition of the radiation fields of the two radiators at an electrical phase angle of ±90° therefore occurs by way of the phase difference of the electromagnetic wave, which results from the distance of λ/4 of the electrical dipole radiator 1 from the electrically conductive base surface 2. In this connection, the signal powers that prevail at the slot radiator connection location 7 and at the dipole connection location 8 should be selected to be about equal. In this connection, the one at the dipole connection location 8 should be set correspondingly lower than at the slot radiator connection location 7, because of the bundling of the radiation that results together with the electrical dipole radiator 1 that is mirrored on the electrically conductive base surface 2.

Accordingly, to achieve the circular polarization at a specific predetermined elevation angle, both the signal powers and the electrical phase angles at the two radiator connection locations 7, 8 are to be selected in accordance with the different magnitudes of the directional diagrams of the two radiators, i.e. their different phases with reference to a remote receiving point. The distance 14 can also be advantageously varied to set the vertical directional diagram of the electrical dipole radiator 1, and does not have to be selected to be precisely λ/4.

Combining network 13, and dipole feed line 6 are configured to fulfill both the condition of the phase shift of +−90° degrees, depending on the direction of rotation of the polarization, and of the equality of the intensity of the superimposed radiation fields in the remote field. This combining network 13 is connected to the antenna connection location 12, in FIG. 1, by way of an antenna line 11 that is configured non-symmetrically with reference to the electrically conductive base surface 2, as a mass surface, and is formed in the vicinity of the center Z. In this connection, one of the slot connection points 19 of the slot radiator connection location 7 is formed by the mass connector of the antenna line 11 on one of the two longitudinal edges 18. The other one of the slot connection points 19 is connected adjacent on the opposite longitudinal edge 18, by means of connecting the voltage-carrying conductor of the antenna line 11.

In one embodiment, the dipole feed line 6 is structured as a symmetrical two-wire line. Its two conductors are connected with one of the slot connection points 19 of the slot radiator connection location 7, in each instance, with their feed line connection points 25. In this way, a conversion of the signals passed by means of the antenna line 11, in non-symmetrically polarized manner, to the signals passed on the symmetrical two-wire line, which are symmetrically polarized with reference to the electrically conductive base surface 2, is achieved in low-effort manner. The feed line connection points 25 are therefore also formed by means of the slot connection points 19 of the slot radiator connection location 7.

In at least one embodiment, dipole lead line 6 is configured to transform the impedance that is present at the dipole radiator connection location 8 into the impedance of the dipole feed line 6 that is required at the feed line connection points 25 for equal intensity of the radiation fields of the two radiators, as well as the adjustment of the required phase take place, according to one embodiment of the invention, by way of the configuration of the dipole feed line 6.

The impedance at a slot radiator connection location 7 affixed in the center Z of a slot radiator 3 is generally significantly higher, at up to several kilo-ohms, than that of an extended dipole radiator, at values below 100 ohms. In the interests of line characteristic impedances that can be implemented in technically simple manner, a chain circuit of multiple lines having different characteristic impedances and an electrical length of λ/4, in each instance, can be used. In this case, the great impedance of the slot radiator 3, in comparison with the characteristic impedance of lines that can be technically implemented, is bridged to the impedance level of the electrical dipole radiator 1, in two steps. For such an impedance transformation, carried out in multiple steps, there are sufficiently low-ohm line wave resistors that can be implemented on usual electrical circuit boards.

In at least one embodiment the dipole feed line 6 is configured by means of two λ/4 transformers in a chain circuit. In a first transformation step, first the extremely high impedance of the slot radiator 3 at the slot radiator connection location 7 is transformed by means of a line having an electrical length of λ/4, having an impedance that can be technically implemented, into an impedance that is less than the impedance of the electrical dipole radiator 1. The characteristic impedance required for this can be implemented as band power. The further transformation—proceeding from this impedance level—into the relatively higher resistance of the electrical dipole radiator 1, can then take place in a second transformation step, with a line having an electrical length of λ/4, also having a line characteristic impedance that can easily be implemented technically.

An example of one embodiment of an antenna, the dipole feed line can have an electrical length of λ/2 in the location of the dipole feed line 6. If necessary, another line piece can be added, to bring about additional phase rotations. Geometrically, this dipole feed line 6, which has a total electrical length of λ/2, can easily be disposed by means of conducting the line in meander shape, essentially symmetrical to the vertical symmetry line ZL and running in the plane of symmetry SE, so that in total, the geometric length of λ/4 is bridged. With a carrier material having an effective dielectricity coefficient ∈r of 4, the extended length of a line having a length of λ/2 then yields a geometric length of precisely λ/4. In the case of carrier materials having an effective dielectricity coefficient ∈r of greater than 4, it is then advantageous to use another line piece having an electrical length of λ/2 as another component of the dipole feed line 6, in order to continue to fulfill the phase requirement. The antenna can be used alternatively for left-polarized or right-polarized signals, by means of interchanging the feed line connection points 25.

In another embodiment, the dipole and the dipole feed line 6 are printed onto the circuit board. This technology allows the configuration of the characteristic impedance and the transformation properties of the feed line 6 within broad limits. In the same manner, inductive and capacitative dummy elements or concentrated dummy elements printed onto the circuit board can be applied for configuring adaptation networks 10 and/or phase rotation elements 17. Using known circuits composed of concentrated dummy elements, it is possible to implement transformation circuits having a resonance nature—for example, as a parallel oscillating circuit with partial coupling—which make it possible to transform the adaptation of the low impedance of the electrical dipole radiator 1 to the impedance level of the high-ohm slot radiator 3.

In another embodiment, the dipole feed line 6 comprises an imprinted symmetrical two-wire line that is connected to the electrical dipole radiator 1 at its one end, and is connected, at its other end, to a transformation circuit that consists of dummy elements and has a resonance nature, which brings about the impedance adaptation to the high impedance level of the slot radiator 3. With this design, the line length required to fulfill the phase condition is provided by means of a meander-shaped configuration of the feed line 6, which is guided to run essentially symmetrical to the vertical symmetry line ZL and in the plane of symmetry SE. Likewise, to balance out the electrical length of the dipole feed line 6, phase rotation chain circuits composed of concentrated dummy elements can be used, which do not transform the impedance.

In another embodiment, the combining network 13 is formed from a circuit that essentially comprises of concentrated dummy elements. By means of these impedance transformation and phase rotation properties, both the phase condition and the power condition required to achieve circular polarization can be fulfilled.

In FIG. 2, in another embodiment, the combining network 13 is connected with the antenna connection location 12 by way of an antenna line 11, which is configured in non-symmetrical manner with reference to the electrically conductive base surface 2. Surface 2 acts as a ground surface, wherein network 13 and is formed in the vicinity of the center Z, similar to FIG. 1, in that the one of the feed line connection points 25 is formed by the ground connector of the antenna line 11 on one of the two longitudinal edges 18. The other connector of the feed line connection points 25 is formed by connection of the voltage-carrying conductor of the antenna line 11, adjacent on the opposite longitudinal edge 18. In addition, the dipole feed line 6 with its feed line connection points 25, is also connected there.

The slot radiator connection location 7, however, is formed at a distance 16 from the center Z, and connected by way of a parallel branching of the non-symmetrical antenna line 11, by way of slot connection points 19 formed in analogous manner. The antenna resistance of the slot radiator 3 at resonance is maximal when forming the slot radiator connection location 7 in the center Z, and is generally greater than the characteristic resistance of usual lines. It changes toward smaller values with an increasing distance 16 from the center Z. In the interests of better adaptation to such line structures, it is therefore advantageous, according to the invention, to select the distance 16 accordingly. In this connection, fulfillment of the phase and power conditions takes place, according to the invention, in the part of the line conducted between the parallel branching of the antenna line 11 and the slot radiator connection location 7, on the one hand, and toward the dipole connection location 8, on the other hand.

The circular polarization at the desired elevation angle is achieved, in targeted manner, by means of inserting adaptation networks 10 and/or phase rotation elements 17 into the dipole feed line 6, as shown in FIG. 3, as well as by means of their transformation properties and by means of the slot width 5 of the slot radiator 3.

In FIG. 5, antenna line 11 to the slot radiator connection location 7 is configured as a strip line 20, which is non-symmetrical with reference to the electrically conductive base surface 2, which functions as a ground surface. Strip line 20 is coupled to the slot of the slot radiator 3 in known manner, by means of radiation coupling. For this purpose, the strip conductor 20 is guided perpendicular to the longitudinal expanse of the slot radiator 3, in the location of its slot, and at least partly over the slot. By means of this arrangement, at least one of the slot connection points 19 is formed by the ground point at the location where the strip conductor crosses the one of the longitudinal edges 18 in a top view. The other one of the slot connection points 19 is formed by means of contact-free radiation coupling of the voltage-carrying strip conductor to the opposite longitudinal edge 18.

A distance 16 from the center of the slot radiator, is selected to provide the characteristic impedance of usual lines, for example 50Ω. Therefore, a low line characteristic impedance would be lower than 50Ω. The dipole radiator connection location 8 is disposed, once again, in center Z of the slot radiator 3, in the example of FIG. 5, whereby the two dipole feed line connection points 25 are again disposed on the two line edges 18. Slot radiator 3 is additionally damped by means of the electrical dipole radiator 1 connected at the center, so that the distance 16 must be selected to be smaller, accordingly, than it would be selected for adaptation without this damping. The signal power that is passed to the electrical dipole radiator 1 by way of the dipole feed line 6, by means of the feed line connection points 25 disposed in the center of the slot radiator 3 and by slot radiator connection location 7 disposed at the distance 16 from it, is passed over parts of the slot radiator 3. Thus, slot radiator 3 is partly incorporated into the combining network 13 for dividing up the signal power that is present at the antenna connection location 12, to the slot radiator 3, on the one hand, and the electrical dipole radiator 1, on the other hand.

For mobile applications of the antenna for example on the roof of a vehicle—it can be useful to configure the longitudinal expanse 4 of the slot radiator 3 to be shorter than λ/2. Transverse slots 22 coupled to slot radiator 3 can be used to provide the required shortening, wherein these slots are orientated transverse to symmetry line SL. For reasons of azimuthal rotation symmetry of the directional diagram of the antenna, these transverse slots are advantageously structured to be the same at both ends and symmetrical to the longitudinal symmetry line SL, as shown in FIG. 4. Depending on the transverse slot length 23 and the transverse slot width 24, the slot resonance frequency therefore occurs at a smaller longitudinal expanse 4 than half the free-space wavelength λ.

In corresponding manner, the length of the electrical dipole radiator 1 can be shortened in that it is burdened with a similar end capacitor 21 at its two ends, in each instance. Such end capacitors 21 can be formed, for example, as indicated in FIG. 4, by means of conductor structures that are oriented essentially vertically. Such conductor structures are particularly advantageous because the transverse dimension of the parts of the antenna that are situated above the electrically conductive base surface 2 is not increased by them.

In at least one embodiment, the electrically conductive base surface 2 is provided by the outer surface of an electrically conductive vehicle body itself, formed from sheet metal, in which the slot radiator 3 is introduced into the sheet metal. In general, however, it is more advantageous, for reasons of easier production, if an electrically conductive body, into the outer surface of which the slot radiator 3 is configured, is introduced into the corresponding recess in an electrically conductive vehicle body, and connected with this recess in electrically conductive manner. In at least one embodiment, the surface of the electrically conductive body is then configured in such a manner that it essentially fills the recess of the electrically conductive vehicle body, and supplements its surface with its own surface, essentially forming a plane. Thus, the electrically conductive base surface 2 is formed in this manner. In this connection, it is advantageous that the recess to be introduced into the vehicle body can be selected, in terms of its longitudinal and transverse expanse, to be only slightly larger than the dimensions the slot requires.

If the vehicle body is not electrically conductive—in other words made of plastic, for example—the electrically conductive base surface 2 is configured as a conductive surface, preferably from sheet metal, and affixed underneath the vehicle skin. The slot radiator 3 is introduced into this surface, and, in one embodiment, it carries the cavity resonator 15 on its back and the electrical dipole radiator 1 and the dipole feed line 6 on its front. Assembly of the antenna on the inside of the vehicle body can take place through a recess that is comparatively small in its transverse dimension. The dimensions of the electrically conductive base surface 2 are to be selected sufficiently large, in two dimensions, so that the radiation properties of the antenna are approximately set, as they apply for an antenna of this type, with an extended electrically conductive base surface 2.

Accordingly, while a few embodiments of the present invention have been shown and described, it is to be understood that many changes and modifications may be made thereunto without departing from the spirit and scope of the invention as defined in the appended claims.

LIST OF REFERENCE SYMBOLS electrical dipole radiator 1
electrically conductive surface 2
slot radiator 3
longitudinal expanse 4
transverse expanse 5
dipole feed line 6
slot radiator connection location 7
dipole radiator connection location 8
resymmetrization element 9
adaptation network 10
antenna line 11
antenna connection location 12
combining network 13
dipole distance 14
cavity resonator 15
distance 16
phase shifter network 17
longitudinal edges 18
slot connection points 19
strip line 20
end capacitor 21
transverse slot 22
transverse slot length 23
transverse slot width 24
feed line connection points 25
plane of symmetry SE
longitudinal symmetry line SL
center Z
vertical symmetry line ZL
wavelength λ

What is claimed is:

1. An antenna for circular polarization, comprising:

a) an electrical dipole radiator (1);

b) an electrically conductive base surface (2) having a front side and a back side, and having an antenna connection location (12) on said front side, wherein said electrical dipole radiator (1) is coupled to said electrically conductive base surface (2) and runs at a distance along said front side of said electrically conductive base surface (2) and in a plane of symmetry (SE) oriented perpendicular to said electrically conductive base surface (2), wherein said electrical dipole radiator (1) is oriented essentially parallel to the electrically conductive base surface (2), c) a dipole feed line (6) coupled at a first end to said electrical dipole radiator (1), said dipole feed line having a dipole connection location (8) which connects to said electrical dipole radiator (1), wherein said dipole feed line (6) runs in the plane of symmetry SE toward the electrically conductive base surface (2), d) a slot radiator (3) configured in and coupled to said front side of said electrically conductive base surface (2), said slot radiator having a longitudinal expanse (4) along an intersection line between the plane of symmetry SE and said electrically conductive surface (2), said slot radiator (3) comprising:

i) a plurality of longitudinal edges (18);

ii) at least one slot radiator connection location (7);

iii) a plurality of connection points (19, 25) configured to connect said dipole feed line (6) to said slot radiator, said plurality of connection points (19, 25) comprising at least one set of connection points situated at said plurality of longitudinal edges (18) and lying opposite one another wherein said at least one set of connection points (19) are disposed in said at least one slot radiator connection location (7);

e) a combining network (13) comprising a connection between said electrical dipole radiator (1) having said dipole feed line (6), said slot radiator (3), and said antenna connection location (12);

wherein said electrical dipole radiator (1) and said slot radiator (3) are tuned to one another in their resonance frequencies, in terms of magnitude and phase, so that circular polarization exists in a remote field at a frequency at which said radiators are tuned to one another.

2. The antenna according to claim 1, wherein said slot radiator (3), with said slot radiator connection location (7), is formed by introducing an elongated, approximately rectangular slot having essentially straight longitudinal edges (18) and a small slot width (5) in comparison with said longitudinal expanse (4) into the electrically conductive base surface (2), with the longitudinal symmetry line (SL) that results from the intersection line between the plane of symmetry (SE) and the electrically conductive base surface (2) running parallel to the longitudinal expanse (4) and passing through a center location (Z) of said slot radiator (3), wherein said electrical dipole radiator (1) and a progression of said dipole feed line (6) are essentially symmetrical to a symmetry line (ZL) that stands perpendicular on said electrically conductive base surface (2) and runs through said center location (Z) of said slot radiator (3), and wherein said electrical dipole radiator (1) with its dipole connection location (8) is fed in electrically symmetrical manner.

3. The antenna according to claim 1, further comprising a cavity resonator (15) to support a radiation on a front side of said slot radiator (3) that faces said electrical dipole radiator (1) and shields against the radiation on a back side of said electrically conductive base surface (2).

4. The antenna as in claim 1, wherein said slot radiator (3) has a longitudinal expanse (4) which amounts to approximately half a wavelength, wherein said electrical dipole radiator (1) is spaced at a distance (14) from said electrically conductive base surface (2) for configuring a circular polarization of the antenna, wherein the dipole spacing distance (14) from said electrically conductive base surface (2) is selected to be about one-quarter of a free space wavelength, and wherein a phase difference of the signals at said dipole connection location (8) and said slot connection location (7) amounts to 0 degrees or a whole-number multiple of 180 degrees, depending on the direction of rotation of the circular polarization, and wherein a set of signal powers that prevail at the two radiator connection locations (7, 8) are of approximately equal size.

5. The antenna as in claim 1, further comprising an antenna line (11), wherein said combining network (13) is connected with said antenna connection location (12) by way of said antenna line (11) that is configured to be non-symmetrical with reference to said electrically conductive base surface (2), and wherein said combining network (13) is formed in a vicinity of a center location (Z) of said electrically conductive base surface (2), said antenna combining network comprising:

i) a slot connection point (19) of a slot connection location (7) which is formed by a mass connector of said antenna line (11) on one of the two longitudinal edges (18), ii) another slot connection point (19) which is formed by connection of the voltage-carrying conductor of said antenna line (11) adjacent on the opposite longitudinal edge (18), and wherein said dipole feed line (6) is structured as a symmetrical two-wire line, the two conductors of which are connected with one of the slot connection points (19), in each instance, so that said slot connection points (25) are also formed by them.

6. The antenna as in claim 1, further comprising an antenna line (11), wherein said combining network (13) is connected with said antenna connection location (12) by way of said antenna line (11) that is configured to be non-symmetrical with reference to the electrically conductive base surface (2) as a mass surface, and wherein said antenna line (11) is formed in the vicinity of a center location (Z), a feed line connection point (25) which is formed by a mass connector of said antenna line (11) on one of said two longitudinal edges (18) of said slot radiator (3);

at least one additional feed line connection point (25) which is formed by connection of a voltage-carrying conductor of the antenna line (11) adjacent on the opposite longitudinal edge (18), that, however, the slot connection location (7) is formed at a distance (16) from the center (Z), in order to reduce the impedance of the slot radiator (3), and is connected by way of a parallel branching of the non-symmetrical antenna line (11), by way of slot connection points (19) formed in analogous manner.

7. The antenna as in claim 5 in the part of the line guided between the parallel branching of the antenna line (11) and the slot connection location (7), on the one hand, and to the dipole connection location (8), on the other hand, the result is brought about that the phase and power conditions are met, by means of inserted adaptation networks (10) and/or phase rotation elements (17), as well as by means of the slot width (5) of the slot radiator (3) and by means of the transformation properties of the dipole feed line (6).

8. The antenna as in claim 5, further comprising a circuit board, wherein said electrical dipole radiator (1) and said dipole feed line (6) are imprinted onto said circuit board, wherein the phase and power conditions are met, by means of configuration of the characteristic impedence and by means of configuration of the line length, by means of guiding the line in meander shape, essentially symmetrical to the vertical symmetry line (ZL).

9. The antenna as in claim 5, wherein said combining network (13) is formed from a circuit consisting of reactive elements, having a set of impedance transformation and phase rotation properties required to fulfill the phase and power conditions.

10. The antenna according to claim 5, wherein said slot radiator has two ends formed as transverse slots which are configured to shorten a longitudinal expanse (4) of the slot radiator (3), wherein said transverse slots (22) have a transverse slot length (23), which are configured to be symmetrical relative to the longitudinal symmetry line (SL) and oriented essentially perpendicular to it, and thus, as a function of the transverse slot length (23) and the transverse slot width (24), said slot resonance frequency occurs at a smaller longitudinal expanse (4) than half the free-space wavelength.

11. The antenna as in claim 5, further comprising at least one capacitor (21) which is coupled to at least one end of said electrical dipole radiator (1) and configured to shorten a length of said electrical dipole radiator (1).

12. The antenna as in claim 1, wherein said electrically conductive base surface (2) is provided by the outer surface of an electrically conductive vehicle body itself, which is formed from sheet metal, and wherein said slot radiator (3) is introduced into the sheet metal.

13. The antenna as in claim 1, wherein said electrically conductive body (2), is coupled to the outer surface of a vehicle body;

wherein said slot radiator (3) is configured, in a recess of said vehicle body and connected with it in electrically conductive manner, so that the outer surface of the electrically conductive body essentially fills a recess of said electrically conductive vehicle body, and supplements its outer surface with its own surface.

14. The antenna as in claim 1, wherein said electrically conductive surface is formed on a vehicle body that is electrically non-conductive, and wherein said electrically conductive base surface (2) is formed by the surface of the electrically conductive body into which the slot radiator (3) is introduced, which surface is selected to be sufficiently large in area.

15. The antenna as in claim 5, wherein, said antenna line (11) to said slot radiator connection location (7) is configured as a strip line (20) that is configured non-symmetrically with reference to said electrically conductive base surface (2), as a mass surface, the strip conductor of which is guided, in a location of a slot of said slot radiator (3), essentially perpendicular to its longitudinal expanse, and at least partly over said slot, thereby causing one of said plurality of slot connection points (19) to be formed by a point on said electrically conductive base surface (2) at a location where said strip conductor crosses one of said longitudinal edges (18) in a top view, and another slot connection point (19) to be formed by means of contact-free radiation coupling of said voltage-carrying strip conductor to an opposite longitudinal edge (18).

16. The antenna as in claim 15, wherein said combining network (13) further comprises said slot radiator (3), so that a signal power that is present at said antenna connection location (25) is divided up between said slot radiator (3) and said electrical dipole radiator (1) which is fed in at a location of said slot radiator (3) at said slot radiator connection location (7), and wherein a feed of the signal power of the electrical dipole radiator (1) results from connecting the feed line connection points (25) at another location of the slot radiator (3).

17. The antenna as in claim 1, further comprising at least two electrical line pieces configured for transformation between the impedance of said slot radiator (3), which is relatively great in comparison with a characteristic impedance of lines that can be technically implemented, to the impedance level of said electrical dipole radiator (1), by means of the dipole feed line (6), this transformation is structured using said at least two electrical line pieces, each having an electrical length of lambda/4, which are connected in a chain, whereby to achieve a sufficiently low-ohm line characteristic impedance that can be technically implemented, an impedance of said slot radiator (3) is transformed to a lower impedance level than that of said electrical dipole radiator (1), by means of this line piece, and this impedance level is transformed to the impedance of said electrical dipole radiator (1), which level is higher, in comparison, by means of an additional line piece having a low line characteristic impedance that can be implemented, which is switched in the chain.

18. The antenna as in claim 1, wherein said at least one slot radiator connection location comprises at least two slot radiator connection locations, wherein plurality of antenna connection points comprise at least one first set of connection points and at least one additional set of connection points, wherein said first set of connection points are disposed in a first slot radiator connection location, and said at least one additional set of connection points are disposed in a second radiator connection location.

19. The antenna as in claim 1, wherein said plurality of antenna connection points comprise at least one first set of connection points and at least one additional set of connection points, wherein said at least one first set of connection points, and said at least one additional set of connection points are disposed in said at least one slot radiator connection location.

20. The antenna as in claim 1, wherein said electrical dipole radiator comprises a first dipole radiator, wherein said plurality of antenna connection points comprise a pair of antenna connection points positioned on opposite sides of said at least one slot radiator, wherein said pair of antenna connection points are configured to have opposite polarity, to form a radiation field forming a second dipole radiator extending transverse to said first dipole radiator.

* * * * *